US006041702A

United States Patent [19]

Ichikawa et al.

[11] Patent Number: 6,041,702

[45] Date of Patent: Mar. 28, 2000

[54] CURVED SURFACE SCREEN-PRINTING APPARATUS

[75] Inventors: Ryuji Ichikawa, Tokyo; Nobuyuki Kuroda, Yokohama, both of Japan

[73] Assignee: Nippon Mitsubishi Oil Corporation, Tokyo, Japan

[21] Appl. No.: 09/311,740

[22] Filed: May 14, 1999

[30] Foreign Application Priority Data

May 18, 1998 [JP] Japan ..... 10-153570

[51] Int. Cl.[7] ..... B41F 17/00

[52] U.S. Cl. ..... 101/35; 101/123; 101/126

[58] Field of Search ..... 101/35, 114, 115, 101/123, 126, 124, 129, 38.1

[56] References Cited

U.S. PATENT DOCUMENTS

| | | | |
|---|---|---|---|
| 2,895,412 | 7/1959 | Reed, III | 101/35 |
| 4,266,476 | 5/1981 | Maloof | 101/35 |
| 4,664,029 | 5/1987 | Best | 101/35 |
| 4,854,229 | 8/1989 | Vassiliou | 101/123 |
| 4,919,043 | 4/1990 | Bubley et al. | 101/123 |
| 5,339,732 | 8/1994 | Peterlini et al. | 101/38.1 |

*Primary Examiner*—Christopher A. Bennett
*Attorney, Agent, or Firm*—Rabin & Champagne, PC

[57] ABSTRACT

A curved surface screen-printing apparatus adapted to screen-print a to-be-printed object having a large radius of curvature. Concentric curved-surface guides having an equal radius of curvature are respectively provided on both side portions of a jig table on which a printing board to be bent and used as the to-be-printed object is placed. A squeegee head crossing over the jig table, and a screen plate mounting frame are provided in the apparatus. A pair of steel belts are used to connect a corresponding one of the guides to the frame. The belts of each pair are made to intersect each other. An end of each of the belts is fixed to a side end portion of a corresponding one of the curved surface guides as viewed from a side thereof. The other end thereof is fixed to a corner portion of the screen plate mounting frame. A reciprocating motion of the squeegee head causes the screen plate mounting frame to perform a rocking motion along the curved surface of the jig table. Thus, an optimum gap between the screen plate and the to-be-printed object is maintained at all times in such a manner as to be uniform therebetween.

20 Claims, 9 Drawing Sheets

CURVED SURFACE SCREEN-PRINTING APPARATUS

BACKGROUND OF THE INVENTION

1. Field of the Invention

The present invention relates to a curved surface screen-printing apparatus for screen-printing a bent object.

2. Description of the Related Art

Screen-printing techniques for screen-printing cylindrical objects and bent objects have been known. Such conventional techniques print a pattern on a curved surface of a to-be-printed object by synchronously rotating the object. The to-be-printed object is limited to a radius of curvature of 0.3 to 0.4 m or so.

In recent years, there have been demands for screen-printing a to-be-printed object having a radius of curvature of 0.5 m or more. The radii of curvature of some to-be-printed objects reach 50 m. It is, however, extremely difficult to incorporate a device for rotating a to-be-printed object having a large radius of curvature into an existing printer. Thus, it is almost impossible to directly print a such a to-be-printed object.

Hitherto, to print such a cylindrical or bent object, a method has been adopted of first printing a planar object and then bending the printed object. Alternatively, a transfer printing method for transfer printing has been employed. The former method, however, has a drawback in that a printed surface of a to-be-printed object may be damaged because the object is bent after being printed. Further, the latter method has a drawback in that a misregister may occur when printing a large object. Thus, both of these methods are inferior both in finish and in the required time and effort to a method of directly printing a to-be-printed object.

SUMMARY OF THE INVENTION

Accordingly, an object of the present invention is to provide a curved surface screen-printing apparatus that can screen-print a to-be-printed object having a large radius of curvature by using a conventional screen-printing machine.

To achieve the foregoing object, according to the present invention, there is provided a curved surface screen-printing apparatus that comprises a jig table on which a printing board to be bent in such a way as to have an arcuate section and used as a to-be-printed object is placed, curved surface guides which have an equal radius of curvature and are respectively provided on both side portions of the jig table in such a way as to be concentric with the table, a squeegee head which is adapted to move in a direction perpendicular to a longitudinal direction of each of the curved surface guides and is provided in such a manner as to cross over the jig table, a screen plate mounting frame which is provided above the jig table, and a pair of steel belts connecting a corresponding one of the guides to the frame. In this apparatus, the belts and of each pair are placed in such a way as to intersect each other. Further, an end of each of the belts and is fixed to a side end portion of a corresponding one of the curved surface guides as viewed from the side thereof, whereas the other end thereof is fixed to a corner portion of the screen plate mounting frame. Moreover, a reciprocating motion of the squeegee head causes the screen plate mounting frame to perform a rocking motion along a curved surface of the jig table. As a result of providing a pair of two steel belts and at each of the left-hand side and the right-hand side of the apparatus as viewed from the front thereof, an optimum gap for screen-printing is maintained between the screen plate and the to-be-printed object in such a manner as to be uniform therebetween. Thus, a to-be-printed object having a radius of curvature can be screen-printed by utilizing an ordinary screen-printing machine.

In an embodiment of this apparatus, a curved guide rail having a radius of curvature being equal to that of each of the curved surface guides is provided on a each of the guides in such a way as to be concentric therewith. In this embodiment, a connector is movably provided on each of the curved guide rails. The connectors are slidably connected to the top surface of the screen plate mounting plate. Interlocking arms provided on the squeegee head are slidably linked with the connectors, respectively. Thus, a rocking motion of the screen plate mounting frame is stably imparted.

Further, in another embodiment of the apparatus, each of the connectors comprises rollers arranged in such a way as to respectively push a corresponding one of the curved guide rails from above and below, and guide wheels adapted to roll on the top surface of the screen plate mounting frame, thereby enabling each of the connectors to move along a corresponding one of the curved guide rails. Thus, a rocking motion of the screen plate mounting frame can be more stably imparted.

In still another embodiment of the apparatus, each of the connectors has an interlocking arm that is rotatably attached to a corresponding one of sliders slidably provided on the connectors, respectively. Consequently, a rocking motion of the screen plate mounting frame is more stably imparted.

In yet another embodiment of the present invention, each of the steel belts and are fixed to a corresponding belt mounting piece provided at a side end portion thereof as viewed from a side thereof in such a manner as to be able to turn around a shaft. Further, an angle of inclination of the belt mounting piece with respect to a corresponding one of the curved surface guides is adjustable. Moreover, a tensile force of each of the belt mounting pieces is adjusted by changing the angle of inclination thereof. Thus, a deviation in position of the screen plate is eliminated by laterally uniformly maintaining forces to tension the screen plate mounting frame.

In still another embodiment of the apparatus, a curved guide rail having a radius of curvature equal to that of each of the curved surface guides provided on each of the guides in such a way as to be concentric therewith. Further, a support arm is movably provided on each of the curved guide rails. Moreover, each of the support arms is slidably connected to the top surface of the screen plate mounting frame. Furthermore, the squeegee head is connected to each of the support arms. Thus, the squeegee head rocks while the distance to the jig table therefrom is maintained at a constant value. As a result, the contact pressure exerted on the screen plate by the squeegee does not change during a printing operation. Consequently, the printing is finished nicely.

In yet another embodiment of the present invention, each of the support arms comprises rollers arranged in such a way as to respectively push a corresponding one of the curved guide rails from above and below, and guide wheels adapted to roll on the top surface of the screen plate mounting frame, thereby enabling each of the support arms to move along a corresponding one of the curved guide rails. Thus, the contact pressure exerted on the screen plate by the squeegee does not change during a printing operation. Consequently, the printing is finished nicely.

In still another embodiment of the apparatus, chains and are respectively provided at both end portions of each of the curved surface guides as viewed from a side thereof. The chains and are connected to piston rods and of air cylinders and, respectively. When the screen plate mounting frame rocks, one of the chains and, which is connected to a lower corner portion of the tilted frame, is pulled to thereby reduce the influence of the weight of the frame to an extent close to zero and balance the frame. Thus, when the screen plate mounting frame is caused to rock, the influence of the weight of the frame and the screen plate is reduced to an extent close to zero. Consequently, the rocking motion of the frame is stably performed.

In yet another embodiment of the apparatus, a guide plate is provided on a frame body, which is parallel to the squeegee head, of the screen plate mounting frame. Further, both side surfaces of the guide plate are supported and sandwiched by cam followers. Thus, a rocking motion of the screen plate mounting frame is more stably performed.

In still another embodiment of the present invention, a plurality of air holes are provided in the surface portion of the jig table. Further, negative pressure air is supplied to the plurality of air holes, so that a printing board to be placed on the jig table is attached and fixed thereto. Thus, the printing board is stably mounted on the jig table. Incidentally, the printing board is made of an inorganic or organic material that is not deformed by negative pressure.

When a bent printing board is screen-printed by the apparatus of the present invention, a printing board is inserted thereto from an open portion of a base frame. Then, the printing board is placed on the jig table. Further, a screen plate 31 is mounted on the screen plate mounting frame.

Subsequently, a timing belt is moved by rotatably driving a drive motor. Thus, the squeegee head is moved to the left-hand end portion of the screen plate mounting frame as viewed from a side thereof (see FIG. 3). When the squeegee head moves to the left as viewed in this figure, the connectors move along the curved guide rails by being syncronously tilted. All during this time, each of the connectors is inwardly radially directed toward the center of curvature of the corresponding curved guide rail. Namely, the curvature of the curved guide rail is equal to that of the jig table serving as a reference. Moreover, the curvature of the printing board is equal to that of the jig table. Thus, during the entire time the screen plate mounting frame moves to the left, the gap between the screen surface of the screen plate and the printing board is maintained in such a manner as to be uniform therebetween.

When the squeegee head reaches the left-hand side portion of the screen plate mounting frame and this frame is tilted so that the left-hand side portion thereof is lowered, the squeegee is pushed-down. Thus, the screen plate is brought into contact with the printing board. Subsequently, the squeegee head is moved to the right. Then, the printing board is screen-printed. As described above, during the time the squeegee moves on the screen plate, the gap between the screen surface and the printing board is maintained in such a way as to be uniform therebetween.

A reciprocating motion of the squeegee head causes the connectors to move along the curved guide rail through the slider. During the time the connectors move thereon, the connectors tilt rightwardly or leftwardly and push the frame body of the screen plate mounting frame, so that the left-hand end or the right-hand end of this screen plate mounting frame is in the lowest position.

Further, in a free state, the screen plate mounting frame is maintained in a horizontal position by being tensioned by the pair of steel belts provided on each of the curved surface guides. Thus, this tensile force induces a stability which causes the screen plate mounting fame to restore to the horizontal position when tilted rightwardly or leftwardly as viewed from the side thereof. Consequently, the gap between the screen surface and the printing board is maintained constant therebetween. Moreover, each of the steel belts and has an adjusting device for adjusting a tensile force. Thus, the screen plate mounting frame can control a balance in a lateral direction. Consequently, occurrences of printing unevenness and positional deviation are prevented.

Furthermore, the piston rods of the air cylinders and the piston rod of the air cylinder are connected to both end portions of the screen plate mounting frame by chains. Thus, a rocking motion of the screen plate mounting frame is stabilized by reducing the influence of the weight thereof to an extent close to zero during the rocking motion.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF THE PREFERRED EMBODIMENTS

Hereinafter, the preferred embodiments of the present invention will be described in detail by referring to the accompanying drawings.

FIGS. 1 to 6B illustrate a first embodiment of the present invention.

Figure 1:
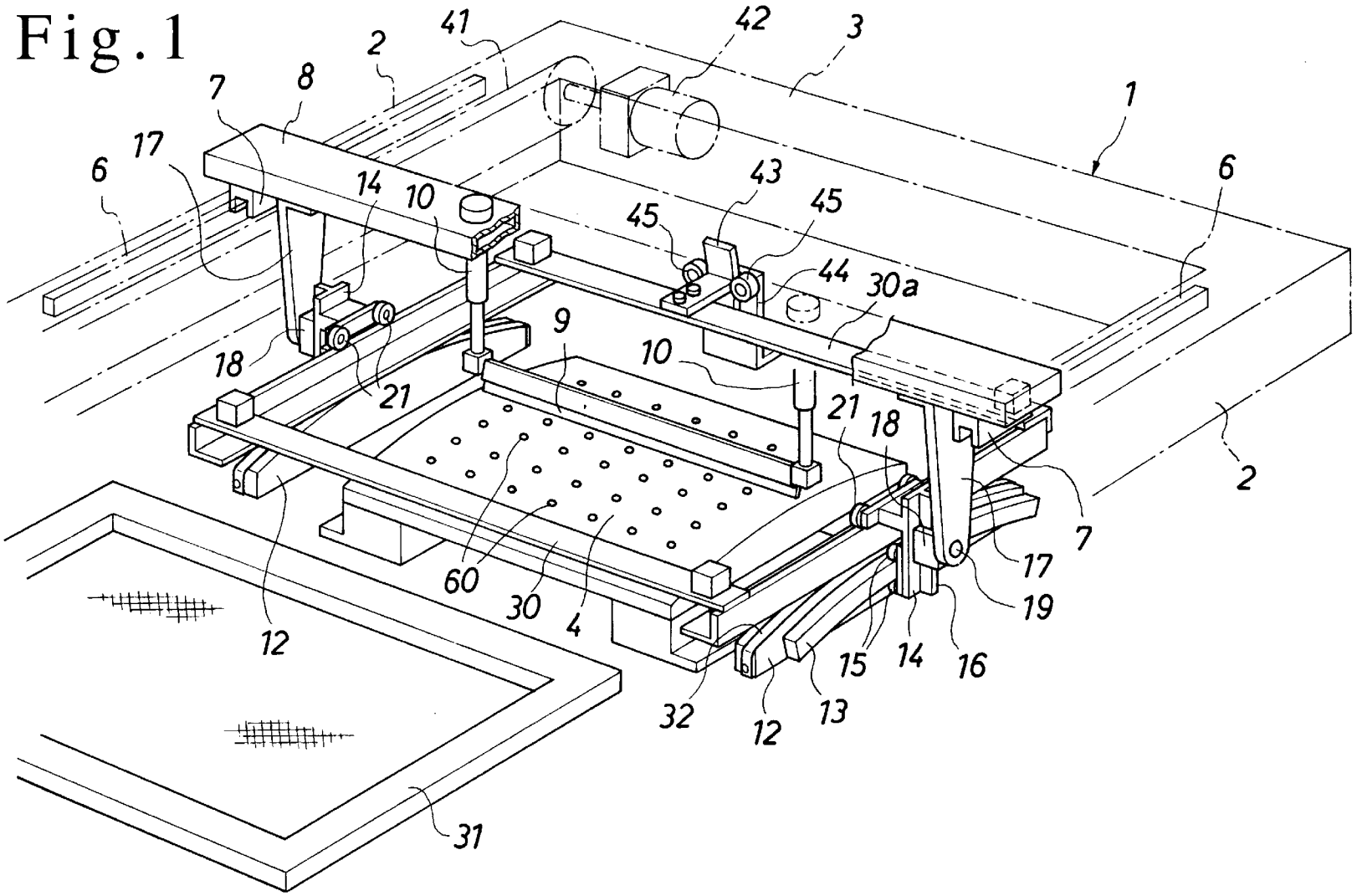
FIG. 1 is a perspective view of a first embodiment of the present invention.
Figure 2:
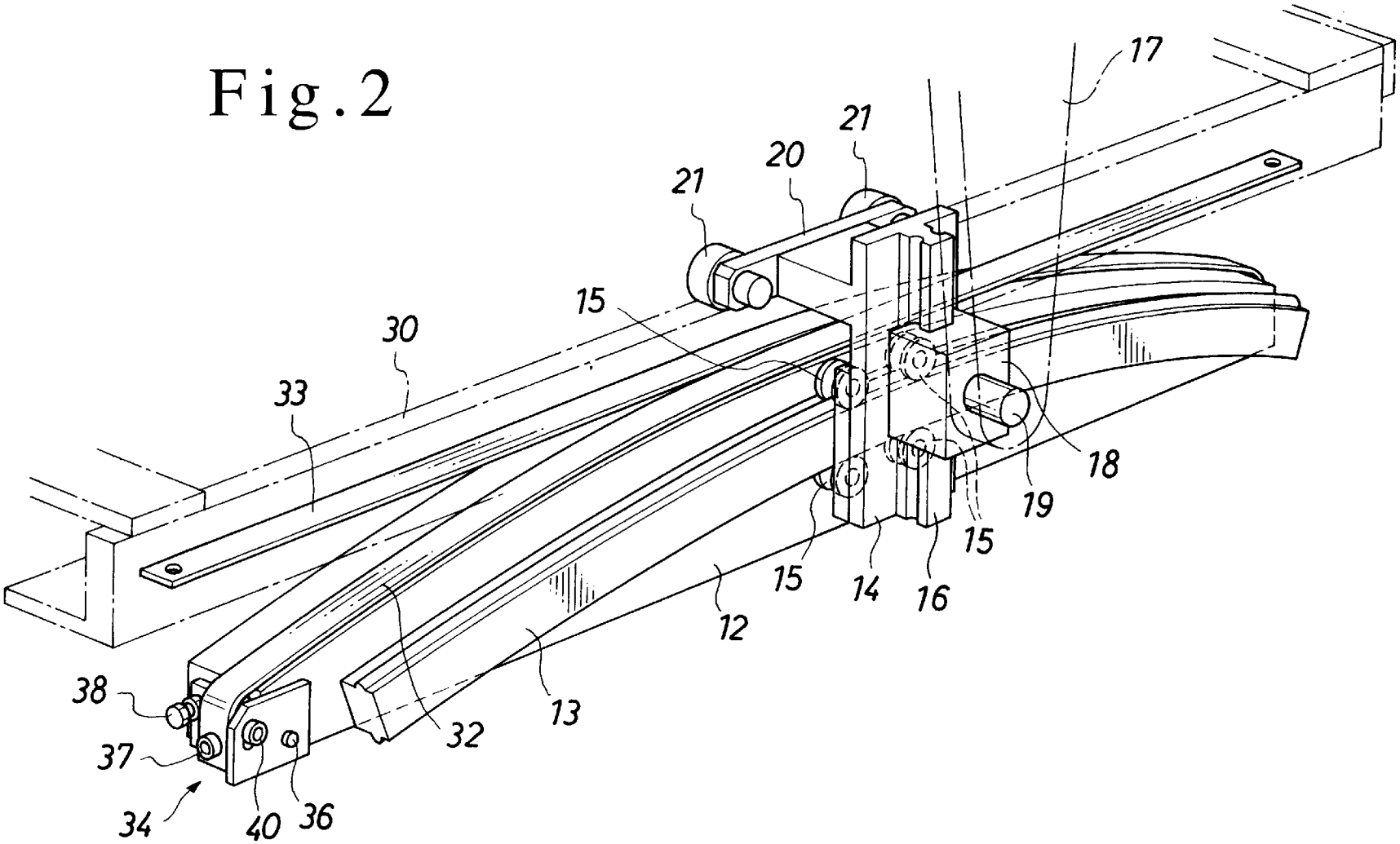
FIG. 2 is a perspective view of a swinging mechanism for rocking a screen plate mounting frame of the first embodiment.

In FIGS. 1 and 2, reference numeral 1 designates a base frame having a U-shaped horizontal section. The base frame 1 is constituted by connecting left-hand and right-hand transverse frames 2 and 2 and a rear frame 3 to one another. The base frame 1 is mounted in a screen printing machine (not shown) through columns (not shown). Further, in the base frame 1, a printing board 5 (see FIG. 3) serving as a to-be-printed object is placed on a jig table 4 bent to have an arcuate section. Arcuate skirt portions are provided which extend towards an open portion of base frame 1 and toward the rear frame 3. The printing board 5 is bent to have a radius of curvature, which is equal to that of a curvature of the jig table 4.

The present invention may be applied to the apparatus in which the radius of curvature of the printing board 5 is within a range of 0.5 to 50 m.

Reference numeral 6 denotes guide rails provided on the top surface of each of the traverse frames 2 of the base frame 1 and extend along the longitudinal direction thereof. A runner 7 is movably placed on each of the guide rails 6. A squeegee head 8 is provided, which extends in a direction perpendicular to the transverse frames 2, and as crosses over the jig table 4. The squeegee head 8 is connected to the runners 7. Further, a squeegee 9 is mounted onto the squeegee head 8 through two mounting rods 10. Each of the mounting rods 10 used for mounting the squeegee 9 has a structure for adjusting the mounting height of the squeegee 9.

Reference numeral 11 designates a second base frame (shown in FIGS. 3 and 4) adjoining each of the transverse frames 2 and connected to the base frame 1. A curved surface guide 12 is provided on the surfaces of each of the second base frames 11, which face both side portions of the jig table 4, respectively. Each of the curved surface guides 12 has a curvature equal to that of jig table 4 and is installed to be concentric with the table 4. Moreover, the jig table 4 and a corresponding radiused guide rail 13 are provided at the opposite sides of each of the second base frames 11, respectively. Reference numeral 14 denotes connectors which connect rollers 15 with curved guide rail 13 from above and below, respectively, in such a way as to be able to move along the rail 13. A guide rail 16 is provided on each of the connectors 14, which extends toward a central portion of the curved surface of each of the curved guide rails 13 parallel to a radial direction of the curved surface thereof.

All the time that the connectors 14 move along the curved guide rail 13, an extension of each of the guide rails 16 is radially directed toward the center of curvature of the corresponding curved guide rail 13.

Reference numeral 17 designates an interlocking arm provided in the vicinity each of end portion of the squeegee head 8 and extending downwardly therefrom. Each of the interlocking arms 17 is coupled through a corresponding connecting shaft 19 to a slider 18. Slider 18 is slidarly is slidably connected to the guide rail 16 provided on the corresponding connector 14. Further, a wheel attaching plate 20 is attached to each of the connectors 14. A pair of guide wheels 21 are attached to a corresponding connector 14 so that the pair of guide wheels 21 face the corresponding connector 14 across the corresponding guide rail 16.

Reference numeral 30 denotes a screen plate mounting frame provided above the jig table 4 and adapted to rock along a direction in which the jig table 4 is bent. The screen plate mounting frame 30 is shaped like a picture frame and has a structure to which a screen plate 31 is attached. The guide wheels 21 roll on the top surfaces of both side portions thereof, as viewed from the open portion of the base frame 1.

Reference numerals 32 and 33 designate a pair of steel belts provided along the top surface of each of the curved surface guides 12. Each pair of steel belts 32 and 33 are placed to intersect each other. Further, an end of each of the belts 32 and 33 is fixed to a side end portion of a corresponding one of the curved surface guides 12, whereas the other end thereof is fixed to a corner portion of the screen plate mounting frame 30. For example that the belt 32 is fixed to the left-hand end of the corresponding curved surface guide 12 as viewed from a side thereof, and further, the belt 33 is fixed at the right-hand end of this guide 12. Moreover, the leading edge of the belt 32 is fixed to the right-hand end of the screen. plate mounting frame 30, and the edge of the belt 33 is fixed to the left-hand end of the screen plate mounting frame 30. A pair of the curved surface guides 12, on each of which a pair of steel belts 32 and 33 are mounted, are provided on both side portions of the jig table 4, respectively. The screen plate mounting frame 30 is balanced in a lateral direction, as viewed from a side thereof, by the tensile forces of the steel belts 32 and 33. Further, the screen plate mounting frame 30 put in a horizontal position is mounted in the apparatus.

The steel belts 32 and 33 of each pair are tightly stretched between the corresponding curved surface guide 12 and the screen plate mounting frame 30 by maintaining a tensioned state thereof. To this end, a belt tensioning device 34 for controlling the tensioned state of the belts, as illustrated in FIGS. 6A and 6B, is provided at a mounting portion of each of the curved surface guides 12.

As shown in FIGS. 6A and 6B, a horizontal portion of a belt mounting piece 35 bent at a right angle is provided in such a manner as to be able to rotate around the shaft 36. Each of the steel belts 32 (or 33) is fixed to an erect portion 35*a* of each of the belt mounting pieces 35 by a setscrew 37. Further, an adjusting bolt 38, which is provided with a lock nut and butted to an end wall portion of the corresponding curved surface guide 12, is screw-connected to the erect portion 35*a* of the belt mounting piece 35. Tension applied to the steel belt 32 (or 33) is controlled by tightening the adjusting bolt 38 to thereby change an angle of inclination of the erect portion 35*a* around the shaft 36. In these figures, reference numeral 39 denotes plates, each of which adjoins the corresponding belt mounting piece 35 and is attached to the corresponding curved surface guide 12 with an adhesive. Fixing bolts 40 are provided, each of which is screw-connected to the erect portion 35*a* of the corresponding belt mounting piece 35 through an elongated hole 39*a* provided in the corresponding plate 39.

The steel belts 32 and 33 are fixed to the corner portions, namely, the side end portions of the corresponding curved surface guide 12 as viewed from the side thereof. Thus, in a free state, the screen plate mounting frame 30 is maintained in a horizontal position by setting the tensile forces of the steel belts 32 and 33 equal to each other. Further, even when the frame 30 is tilted rightwardly or leftwardly, the frame 30 is returned to the horizontal position by eliminating the pressure used to tilt the frame 30.

Thus, the screen plate mounting plate 30 can move along the curved surface guide 12 and rock clockwise or counter-clockwise as viewed from the side of the guide 12. Moreover, the contact point between the leading edge of the squeegee 9, the screen plate 31 mounted on the screen plate mounting frame 30 and the board 5 placed on the jig table 4 follows a circular path in such a manner as to accurately follow the movement of the squeegee.

Furthermore, each of the runners 7 travelling on the transverse frames 2 of the base frame 1 is fixed to a corresponding one of the timing belts 41 as shown in FIG. 1 which belts extend around pulleys (not numbered). A drive motor 42 is connected to one of the pulleys. Further, by driving the drive motor 42 the squeegee head 8 connected to the runners 7 performs a reciprocating motion along the transverse frames 2, and the connectors 14 are moved along the curved guide rails 13 through the interlocking arms 17 and the sliders 18.

On the other hand, the guide wheels 21 provided on the connectors 14 roll on the frame body of the screen plate mounting frame 30. Thus, when each of the connectors 14 moves to the left, namely, when the squeegee head 8 moves to the left as viewed from the side of the curved surface guide 12, the screen plate mounting frame 30 is tilted so that the left-hand end portion of the frame 30 is lower than the other end portion thereof. Conversely, when each of the connectors 14 moves to the right, the frame 30 is tilted so that the right-hand end portion of the frame 30 is lower than the other end portion thereof. Thus, the squeegee 9 provided on the squeegee head 8 moves by following the rocking motion of the screen plate mounting frame 30.

To stably perform the rocking motion of the screen plate mounting frame 30, a guide plate 43 downwardly-extending is provided on the frame body 30*a* that is parallel to the squeegee head 8 (see FIG. 1). The guide plate 43 is sandwiched by cam followers 45, both side surfaces of which are rotatably attached to a stand 44. Consequently, the rocking motion of the screen plate mounting frame 30 is stably performed.

Figure 3:
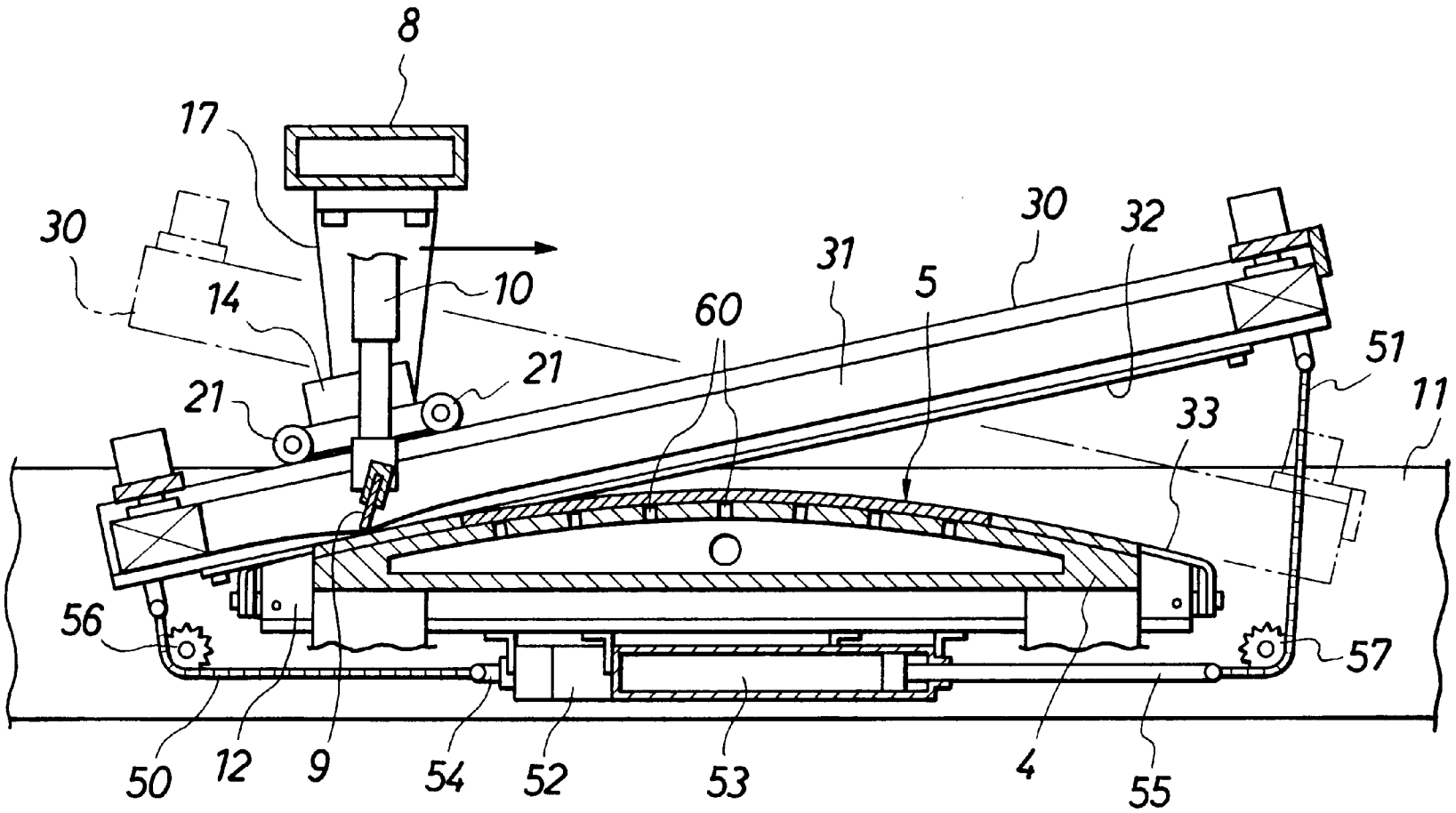
FIG. 3 is a longitudinal sectional side view of the first embodiment.
Figure 4:
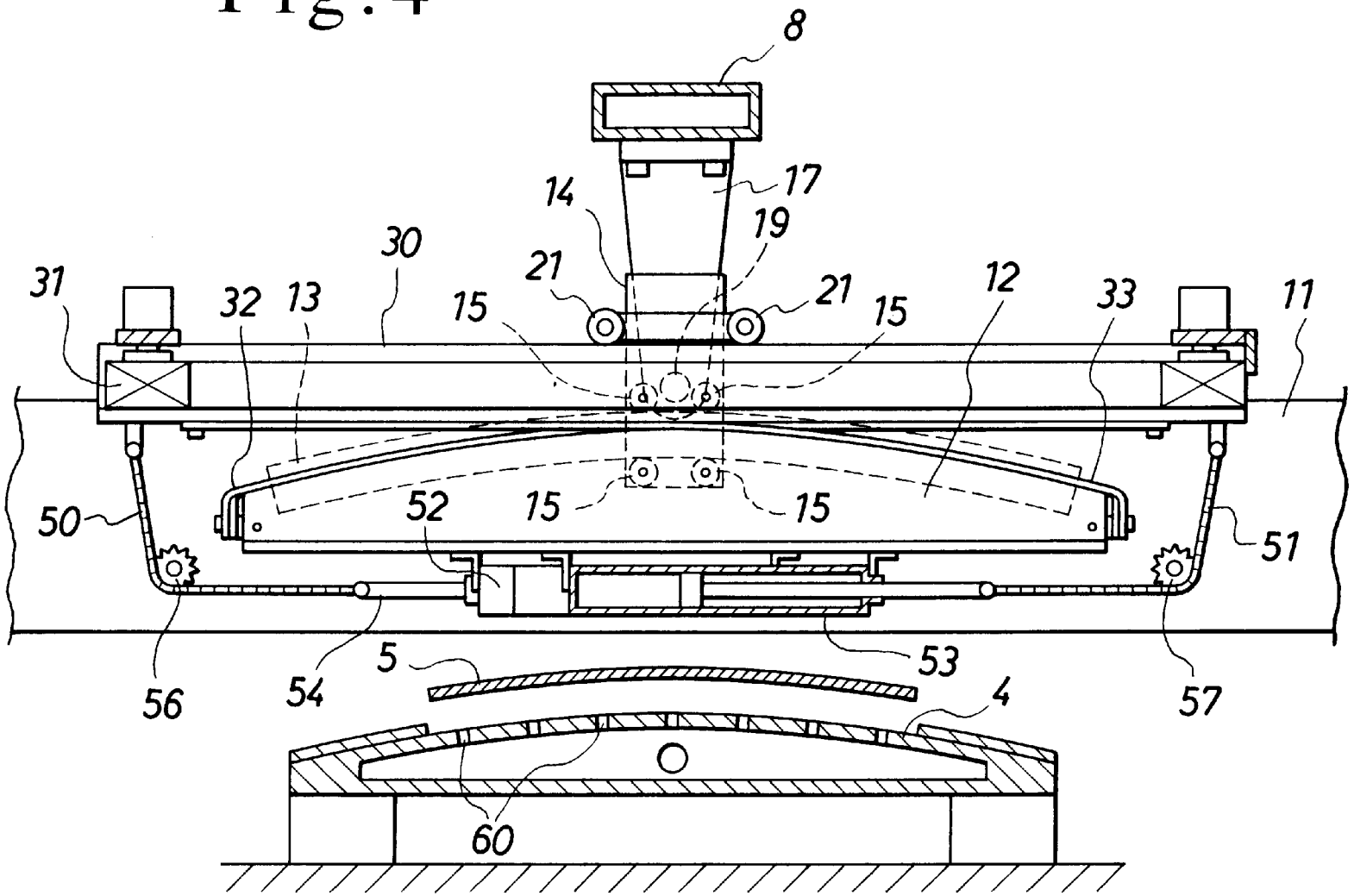
FIG. 4 is a fragmentary sectional view of the first embodiment illustrated in FIG. 3.
Figure 5:
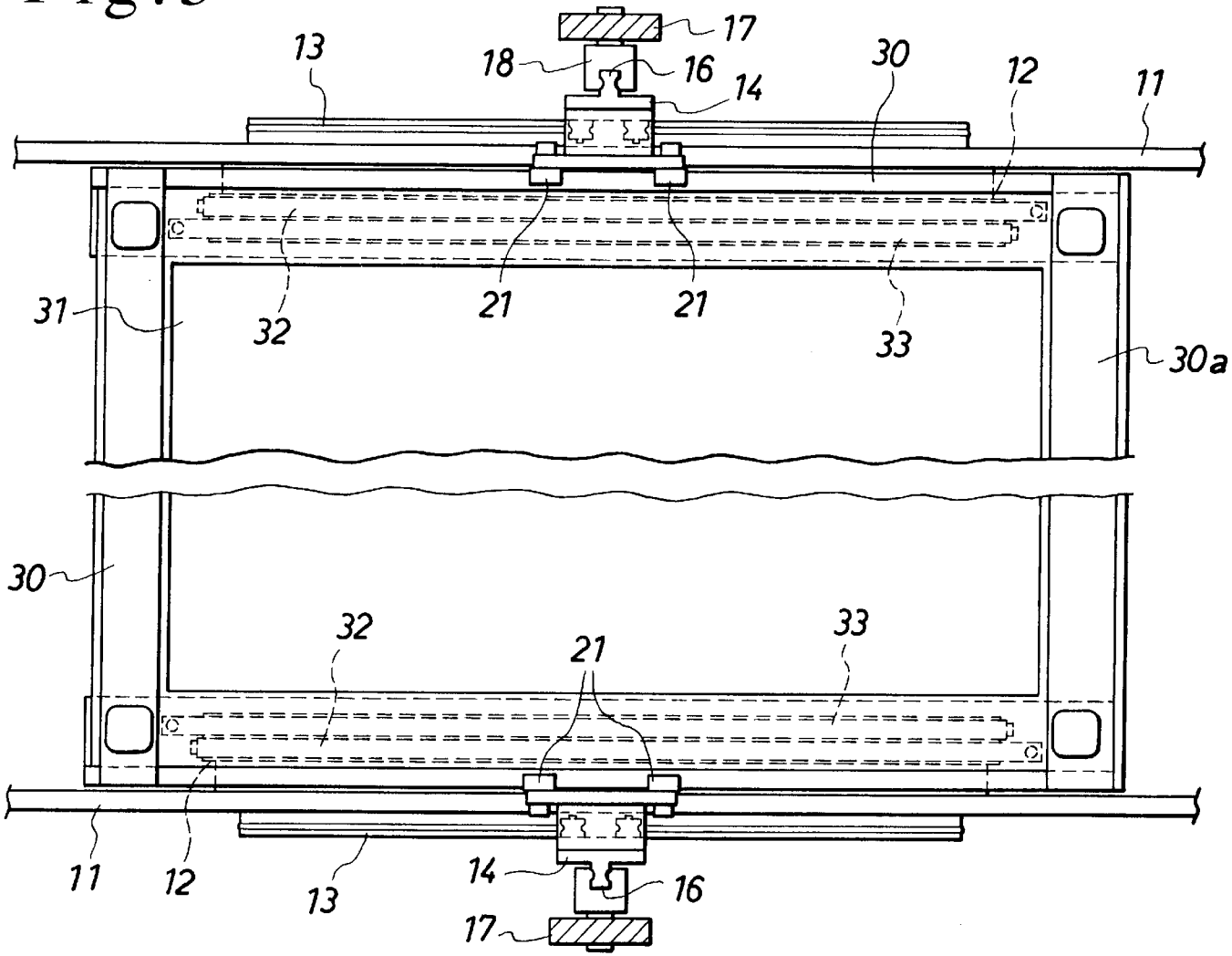
FIG. 5 is a plan view of the first embodiment.
Figure 6:
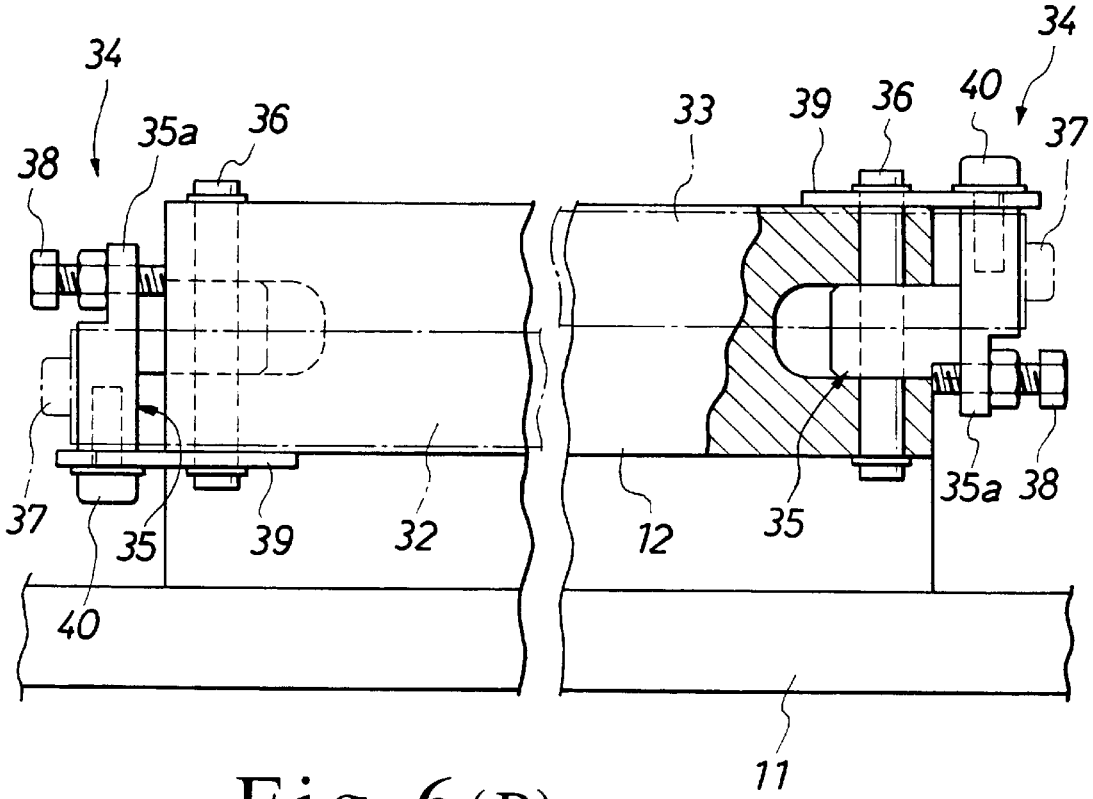
FIG. 6A is a plan view of a steel-belt take-up device.
FIG. 6B is a diagram illustrating a side view of the steel-belt take-up device on the left-hand side part thereof and a partially sectional view of the steel-belt take-up device on the right-hand side part thereof.
Figure 6:
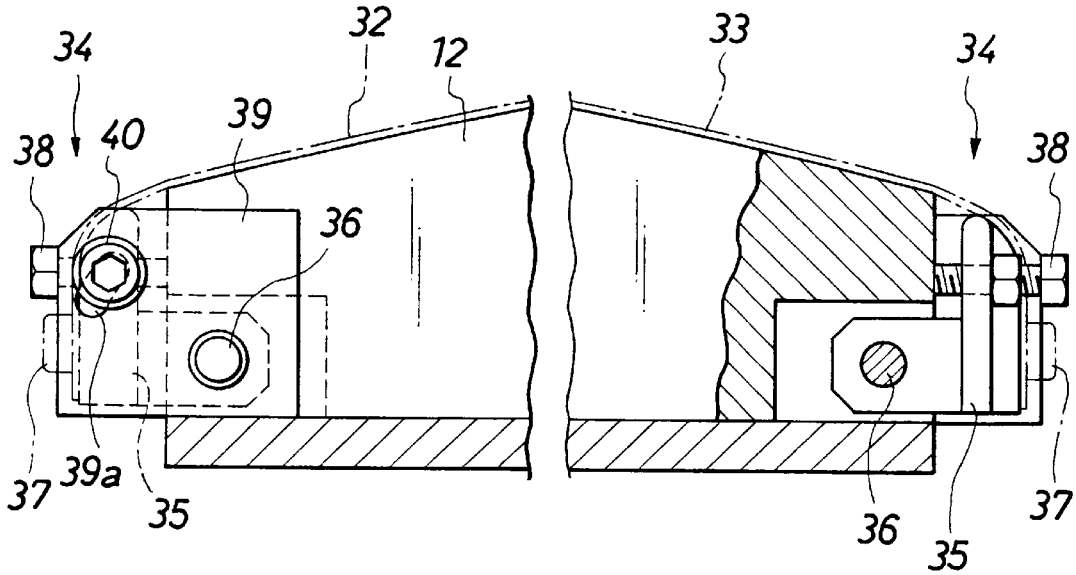

Additionally, the apparatus has other devices for stably performing a rocking motion of the screen plate mounting frame 30. As shown in FIGS. 3 and 4, these devices are air cylinders 52 and 53 for pulling chains 50 and 51 connected to both side end portions of the screen plate mounting frame 30, as viewed from the side of the curved surface guide 12. The chains 50 and 51 are connected to piston rods 54 and 55, respectively. Incidentally, in these figures, reference numerals 56 and 57 denote chain sprockets.

As illustrated in FIG. 3, when the screen plate mounting frame 30 tilts leftwardly (namely, rocks counterclockwise), the left-hand air cylinder 52 is operated to thereby retract the piston rod 54 and pull the left-hand end of the screen plate mounting frame 30. Thus, any influence of the weight of the screen plate and the screen plate mounting frame 30 is reduced to an extent close to zero. Conversely, when the screen plate mounting frame 30 tilts rightwardly (namely, rocks clockwise), the right-hand air cylinder 53 is operated to thereby pull the chain 51 and balance the frame 30.

Thus, the air cylinders 52 and 53 are alternately operated, and the side end portions of the screen plate mounting frame 30 are alternately pulled by timing the operations of the cylinders 52 and 53 to the rocking motion of the screen plate mounting frame 30. Consequently, any influence of the weight of the screen plate mounting frame 30 and the screen plate is decreased to an extent close to zero. Hence, the rocking motion of the frame 30 and the screen plate is stably performed.

Additionally, a plurality of air holes 60 are provided in a surface portion of the jig table 4. The bent printing board 5 placed on the jig table 4 is attached and fixed thereto by supplying negative pressure air to the plurality of air holes 60. Incidentally, the diameters of the air holes 60 are set at values in the range of 1 mm to 10 mm. Further, the diameters of the air holes are suitably determined according to the radius of curvature and to the size of the printing board.

Figure 7:
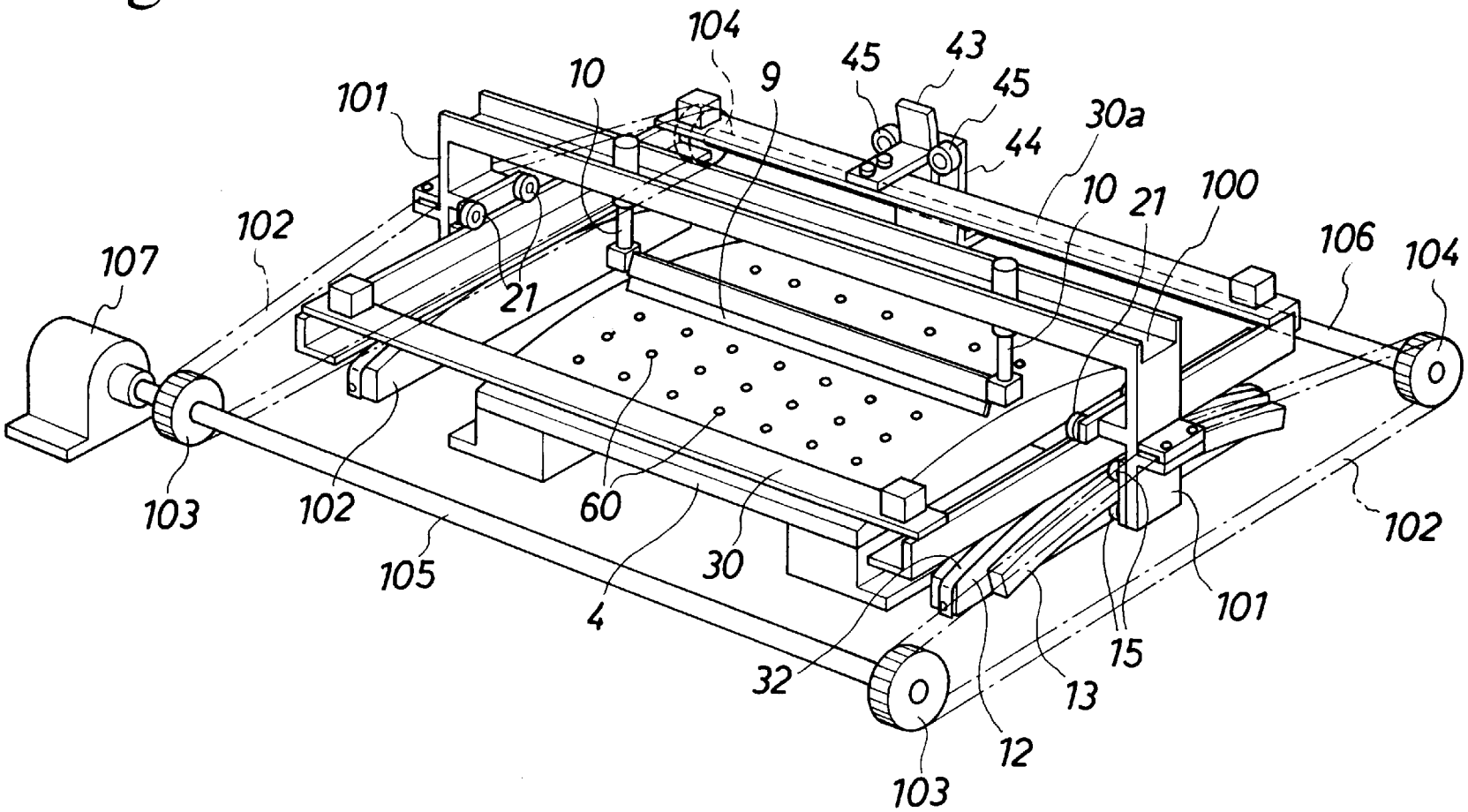
FIG. 7 is a perspective view of a second embodiment of the present invention.
Figure 8:
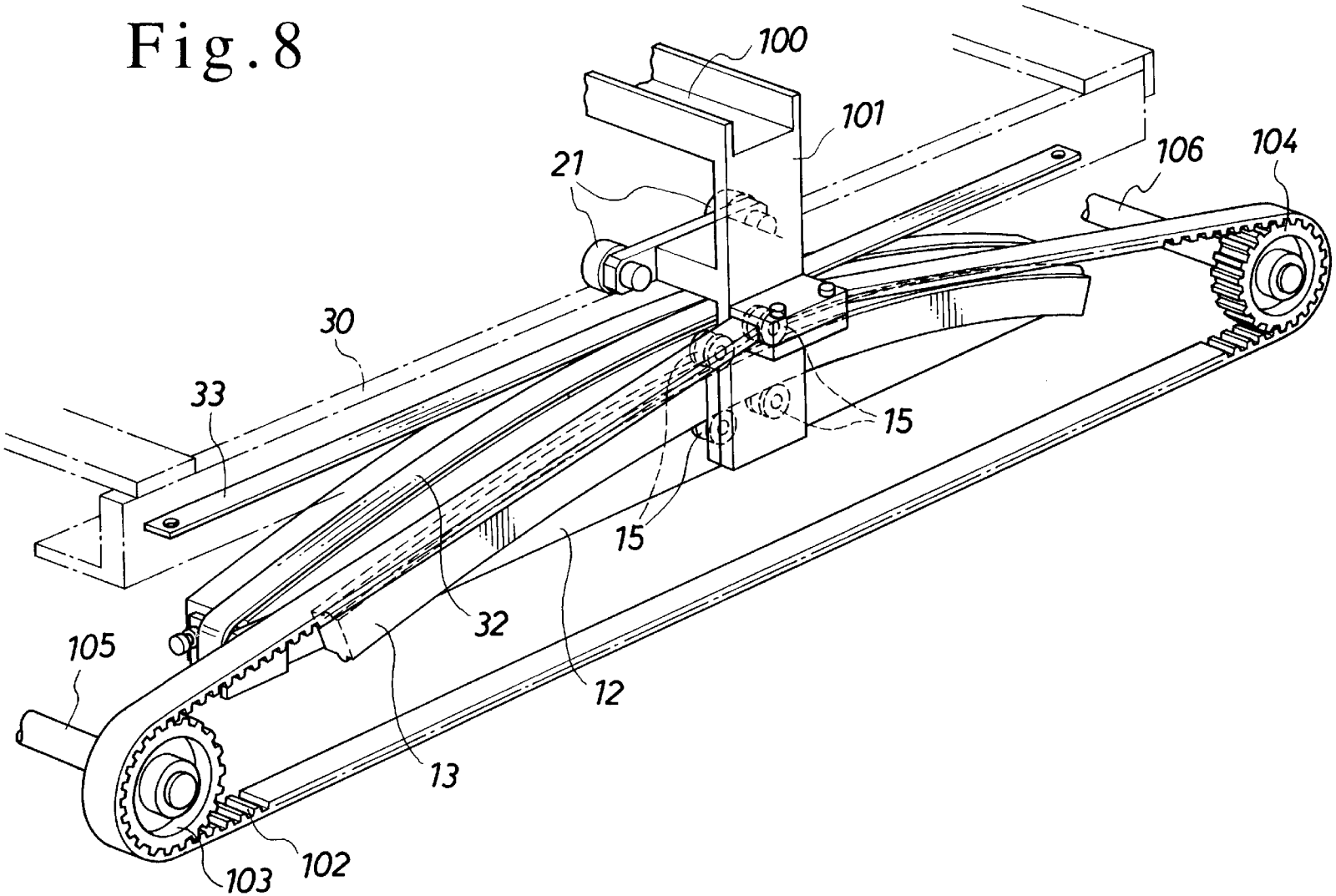
FIG. 8 is a perspective view of a swinging mechanism for rocking a screen plate mounting frame of the second embodiment.
Figure 9:
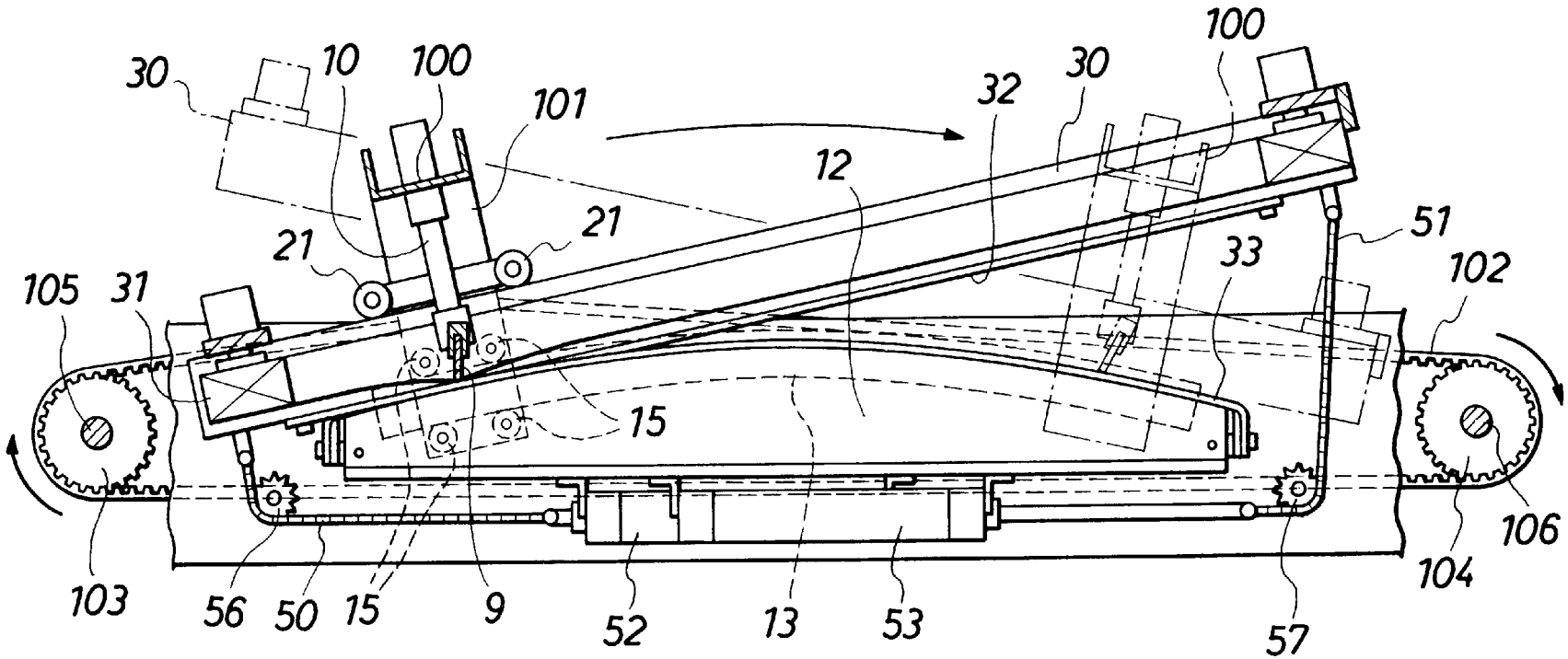
FIG. 9 is a longitudinal sectional side view of the second embodiment.

Referring now to FIGS. 7 to 9, there is shown a second embodiment of the present invention.

Similar to the first embodiment, the second embodiment has a jig table 4 bent to have an arcuate section. Curved surface guides 12 are provided on both side portions of the jig table 4. Curved guide rails 13 are provided on the curved surface guides 12 in such a manner as to have a radius of curvature which is equal to the curvature of the curved surface guides 12 and as to be concentric with the curved surface guides 12.

Furthermore, similar to as in the first embodiment, a pair of steel belts 32 and 33 are provided on the top surface of each of the curved surface guides 12. Each of the steel belts 32 and 33 has an end fixed to the curved surface guide 12 and another end fixed to the screen plate mounting frame 30 that is provided above the jig table 4.

Additionally, in the second embodiment, members designated by the same reference characters as used to denote the aforementioned members of the first embodiment have advantageous effects similar to those of such members of the first embodiment.

The second embodiment features a squeegee head for mounting a squeegee in the apparatus. The squeegee head 100 is installed to cross above the jig table 4, and has downwardly-extending support arms 101, which are provided at both end portions thereof. Further, each of the support arms 101 has rollers 15 arranged to respectively push a corresponding one of the curved guide rails 13 (thus, and the curved surface guides 12, from above and below, and guide wheels 21 adapted to roll on the edge portion of the screen plate mounting frame 30.

Moreover, an endless timing belt 102 is fixed to each of the support arms 101. Each of the timing belts 102 engages two gears, one of which is a driving gear 103 and the other of which is a driven gear 104. The left-hand side gears 103 are mounted on a shaft 105. The right-hand side gears 104 are mounted on a shaft 106. Further, the gears 103 and 104 rotate with the same timing. Reference numeral 107 denotes a drive motor for rotating the shaft 105 on which the driving gears 103 are mounted. The drive motor 107 rotatably drives the shaft 105 forwardly and reversely.

When the drive motor 107 drives and causes the timing belt 102 to move, the support arms 101 move along the curved guide rails 13 by the rolling action of the rollers 15. Further, when the rollers 15 are at the highest place of the rails 13 (and thus, at the highest point on the curved surface guides 102), the support arms 101 are in a vertical position. Conversely, when the rollers 15 reach the lowest place between the left-hand side end portion and the right-hand end portion of the rails 13, the support arms 101 are in a tilted position in which the arms 101 are directed toward the centers of curvature of the rails 13, respectively. Simultaneously, each of the guide wheels 21 moves along the curved surface of the corresponding curved guide rail 13 together with the corresponding arm 101. Thus, the screen plate mounting frame 30 is rocked clockwise and counterclockwise.

Consequently, the rocking motions of the squeegee head 100 and the support arms 101 cause the screen plate mounting frame 30 to rock laterally. Further, the rocking motion of the squeegee head 100 causes the squeegee 9 to move while being simultaneously in contact with the screen plate (not shown) set on the screen plate mounting frame 30. Thus, the printing board (not shown) put on the curved surface guides 12 is screen-printed.

In the second embodiment, the squeegee head 100 performs a rocking motion while moving along the curved guide rails. Namely, the squeegee head 100 performs the rocking motion by maintaining the distance therefrom to the jig table 4 at a constant value. Thus, the screen printing is achieved without changing the contact pressure exerted by the squeegee 9 onto the screen plate. Consequently, the printing finish is enhanced in quality.

Incidentally, the actual radii of curvature of the jig table 4 and the printing board 5 used by the inventors of the present invention are 2.5 m. However, for purposes of illustration, the table 4 and the board 5 are shown in such a way as to have exaggerated radii of curvature.

As described above, according to the present invention, the screen plate mounting frame has a radius of curvature equal to that of a curvature of a printing board. Further, such a frame performs a rocking motion by simultaneously making line contact with the arcuate top surfaces of the guides. Thus, the screen plate is favorably snapped off from the printing board. Consequently, the present invention has an advantageous effect in that the screen printing is directly performed on a printing board having a large radius of curvature.

Although the preferred embodiments of the present invention have been described above, it should be understood that the present invention is not limited thereto and that other modifications will be apparent to those skilled in the art without departing from the sprint of the invention.

The scope of the present invention, therefore, should be determined solely by the appended claims.

What is claimed is:

1. A curved surface screen-printing apparatus, comprising:

a jig table having a curved surface on which a printing board bent to have an arcuate section is placed;

curved surface guides having an equal radius of curvature being respectively provided on side portions of said jig table in such a manner as to be concentric with said jig table;

a squeegee head adapted to move in a direction perpendicular to a longitudinal direction in which each of said curved surface guides extends and crossing over said jig table;

a screen plate mounting frame provided above said jig table; and at least two pairs of metal belts, each pair of metal belts connecting a corresponding one of said guides to said screen plate mounting frame, wherein said belts of each pair are arranged to intersect each other, wherein an end of each of said belts is fixed to a side end portion of a corresponding one of said curved surface guides as viewed from a side thereof, whereas another end thereof is fixed to a respective corner portion of said screen plate mounting frame, and wherein said squeegee head is further movable in a reciprocating motion which causes said screen plate mounting frame to perform a rocking motion along the curved surface of said jig table.

2. The curved surface screen-printing apparatus according to claim 1, further comprising:

a plurality of curved guide rails each having a radius of curvature equal to that of each of said curved surface guides and each being provided on a respective one of said guides to be concentric therewith ;

a plurality of connectors, each being movably provided on a respective one of said curved guide rails, wherein said connectors are slidably connected to a top surface of said screen plate mounting frame; and a plurality of interlocking arms provided on said squeegee head and being slidably linked with said connectors, respectively.

3. The curved surface screen-printing apparatus according to claim 2, wherein each of said connectors has:

rollers arranged in such a way as to respectively push a corresponding one of said curved guide rails from above and below; and guide wheels adapted to roll on the top surface of said screen plate mounting frame, thereby enabling each of said connectors to move along a corresponding one of said curved guide rails.

4. The curved surface screen printing apparatus according to claim 2, wherein each of said connectors has a slider slidably connected thereto, and wherein each of said connectors has a respective one of the interlocking arms rotatably attached to a corresponding one of the sliders.

5. The curved surface screen printing apparatus according to claim 1, further comprising a belt mounting piece rotatable mounted to a shaft connected to a respective curved surface guide, so that said belt mounting piece is provided at a side end portion of said curved surface guide as viewed from a side thereof;

wherein each of said metal belts is fixed to a corresponding one of said belt mounting pieces, wherein an angle of inclination of said belt mounting piece with respect to a corresponding one of said curved surface guides is adjustable, and wherein a tensile force of each of said metal belts is adjusted by changing the angle of inclination of said belt mounting piece.

6. The curved surface screen-printing apparatus according to claim 1, further comprising:

a plurality of curved guide rails, each having a radius of curvature equal to that of each of said curved surface guides and each being provided on a respective one of said guides to be concentric therewith; and a plurality of support arms, each being movably provided on a respective one of said curved guide rails, wherein each of said support arms is slidably connected to a top surface of said screen plate mounting frame, and wherein said squeegee head is connected to each of said support arms.

7. The curved surface screen-printing apparatus according to claim 6, wherein each of said support arms has:

rollers arranged in such a way as to respectively push a corresponding one of said curved guide rails from above and below; and guide wheels adapted to roll on the top surface of said screen plate mounting frame, thereby enabling each of said support arms to move along a corresponding one of said curved guide rails.

8. The curved surface screen-printing apparatus according to claim 1, further comprising:

chains respectively provided at both end portions of each of said curved surface guides as viewed from a side thereof; and air cylinders having piston rods, said chains being respectively connected to the piston rods of the air cylinders, and wherein, when said screen plate mounting frame rocks and tilts, one of said chains, which is connected to a lower corner portion of said frame, is pulled to thereby reduce an influence of a weight of said frame to an extent close to zero and balance said frame.

9. The curved surface screen-printing apparatus according to claim 1, further comprising:

a guide plate provided on a frame body of said screen plate mounting frame, said frame body being parallel to said squeegee head, and wherein said guide plate has surfaces supported and sandwiched by cam followers.

10. The curved surface screen-printing apparatus according to claim 1, wherein a plurality of air holes are provided in the curved surface of said jig table, and wherein negative pressure air is supplied to said plurality of air holes, so that the printing board to be placed on said jig table is attached and fixed thereto.

11. The curved surface screen printing apparatus according to claim 3, wherein each of said connectors has a slider slidably connected thereto, and wherein each of said connectors has a respective one of the interlocking arms rotatably attached to a corresponding one of the sliders.

12. The curved surface screen printing apparatus according to claim 2, further comprising a belt mounting piece rotatably mounted to a shaft connected to a respective curved surface guide, so that said belt mounting piece is provided at a side end portion of said curved surface guide as viewed from a side thereof; wherein each of said metal belts is fixed to a corresponding one of said belt mounting pieces, wherein an angle of inclination of said belt mounting piece with respect to a corresponding one of said curved surface guides is adjustable, and wherein a tensile force of each of said metal belts is adjusted by changing the angle of inclination of said belt mounting piece.

13. The curved surface screen printing apparatus according to claim 3, further comprising a belt mounting piece rotatably mounted to a shaft connected to a respective curved surface guide, so that said belt mounting piece is provided at a side end portion of said curved surface guide as viewed from a side thereof; wherein each of said metal belts is fixed to a corresponding one of said belt mounting pieces, wherein an angle of inclination of said belt mounting piece with respect to a corresponding one of said curved surface guides is adjustable, and wherein a tensile force of each of said metal belts is adjusted by changing the angle of inclination of said belt mounting piece.

14. The curved surface screen printing apparatus according to claim 4, further comprising a belt mounting piece rotatably mounted to a shaft connected to a respective curved surface guide, so that said belt mounting piece is provided at a side end portion of said curved surface guide as viewed from a side thereof; wherein each of said metal belts is fixed to a corresponding one of said belt mounting pieces, wherein an angle of inclination of said belt mounting piece with respect to a corresponding one of said curved surface guides is adjustable, and wherein a tensile force of each of said metal belts is adjusted by changing the angle of inclination of said belt mounting piece.

15. The curved surface screen printing apparatus according to claim 11, further comprising a belt mounting piece rotatably mounted to a shaft connected to a respective curved surface guide, so that said belt mounting piece is provided at a side end portion of said curved surface guide as viewed from a side thereof; wherein each of said metal belts is fixed to a corresponding one of said belt mounting pieces, wherein an angle of inclination of said belt mounting piece with respect to a corresponding one of said curved surface guides is adjustable, and wherein a tensile force of each of said metal belts is adjusted by changing the angle of inclination of said belt mounting piece.

16. The curved surface screen-printing apparatus according to claim 6, further comprising:

chains respectively provided at both end portions of each of said curved surface guides as viewed from a side thereof; and air cylinders having piston rods, said chains being respectively connected to the piston rods of the air cylinders, wherein, when said screen plate mounting frame rocks and tilts, one of said chains, which is connected to a lower comer portion of said frame, is pulled to thereby reduce an influence of a weight of said frame to an extent close to zero and balance said frame.

17. The curved surface screen-printing apparatus according to claim 6, further comprising a guide plate provided on a frame body of said screen plate mounting frame, wherein said guide plate has surfaces supported and sandwiched by cam followers.

18. The curved surface screen-printing apparatus according to claim 8, further comprising a guide plate provided on a frame body of said screen plate mounting frame, said frame body being parallel to said squeegee head;

wherein said guide plate has surfaces supported and sandwiched by cam followers.

19. The curved surface screen-printing apparatus according to claim 6, wherein a plurality of air holes are provided in the curved surface of said jig table, and wherein negative pressure air is supplied to said plurality of air holes, so that the printing board placed on said jig table is attached and fixed thereto.

20. The curved surface screen-printing apparatus according to claim 18, wherein a plurality of air holes are provided in the curved surface of said jig table, and wherein negative pressure air is supplied to said plurality of air holes, so that the printing board placed on said jig table is attached and fixed thereto.

* * * * *